US006012994A

United States Patent [19]

Béluse

[11] Patent Number: 6,012,994

[45] Date of Patent: Jan. 11, 2000

[54] SPORT TRAINING DUMMY

[76] Inventor: Serge Béluse, ERL Étude et Recherche, 4480 Côte-de-Liesse, suite 224, Ville Mont-Royal (Québec), Canada, H4N 2R1

[21] Appl. No.: 08/709,769

[22] Filed: Sep. 9, 1996

Related U.S. Application Data

[60] Provisional application No. 60/014,530, Apr. 2, 1996.

[51] Int. Cl.[7] ..... A63B 69/00

[52] U.S. Cl. ..... 473/446; 473/471; 473/478

[58] Field of Search ..... 473/421, 422, 473/439, 471, 476, 478, 445, 446, 132, 189, 441

[56] References Cited

U.S. PATENT DOCUMENTS

| | | | |
|---|---|---|---|
| 3,658,329 | 4/1972 | Ciccarello | 473/454 |
| 3,709,489 | 1/1973 | Holleran et al. . | |
| 3,765,675 | 10/1973 | DiMarzio | 473/446 |
| 3,840,228 | 10/1974 | Greaney | 473/446 |
| 3,841,630 | 10/1974 | Renna | 473/446 |
| 3,863,917 | 2/1975 | Beale . | |
| 3,887,181 | 6/1975 | Samaras | 473/446 |
| 3,955,815 | 5/1976 | Deschesnes . | |
| 4,168,062 | 9/1979 | McCarthy | 473/446 |
| 4,489,940 | 12/1984 | Amundson | 473/446 |
| 5,192,259 | 3/1993 | Budolfson | 473/446 |
| 5,238,243 | 8/1993 | Grispi | 473/446 |
| 5,335,906 | 8/1994 | Delker . | |
| 5,413,328 | 5/1995 | Glancey | 473/446 |
| 5,433,434 | 7/1995 | Helmetsie | 473/446 |
| 5,498,000 | 3/1996 | Cuneo | 473/446 |
| 5,509,650 | 4/1996 | MacDonald | 473/446 |
| 5,509,652 | 4/1996 | Woronets | 473/446 |
| 5,527,185 | 6/1996 | Davis | 473/438 |
| 5,528,243 | 6/1996 | Grispi | 473/446 |
| 5,584,481 | 12/1996 | Caluori | 473/446 |
| 5,647,747 | 7/1997 | Macri | 473/446 |

FOREIGN PATENT DOCUMENTS

| | | | |
|---|---|---|---|
| 1517970 | 10/1989 | U.S.S.R. | 473/132 |

*Primary Examiner*—Jeanette Chapman
*Assistant Examiner*—Stephen L. Blau

[57] ABSTRACT

The present invention consists of an ice hockey training dummy adapted to be installed onto a playing field to simulate the presence of either a teammate or an adverse party player and comprising in combination a generally flat body having a general outline of a player and attached at its lower part to a support via cylindrical spring clips, the support maintaining the dummy support to maintain the dummy in upright position. One hand of the dummy is built in the body while the second lower hand extends out from said body. The upper part of a hockey stick is built in the body and extends between both hands. The lower freely protruding part of the hockey stick is attached to the dummy via a spring link allowing enough flexibility for the stick lower part to be slightly deflected about the spring link when hit.

8 Claims, 6 Drawing Sheets

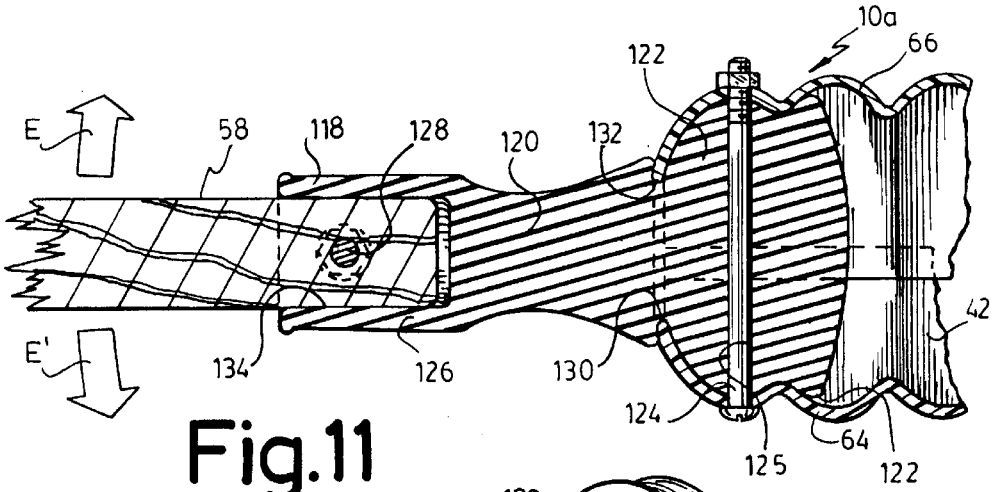
Fig.11
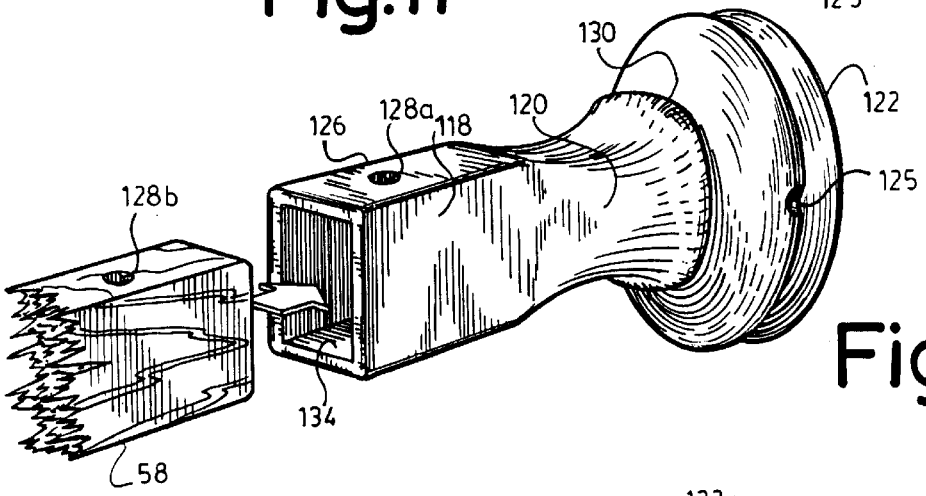
Fig.12
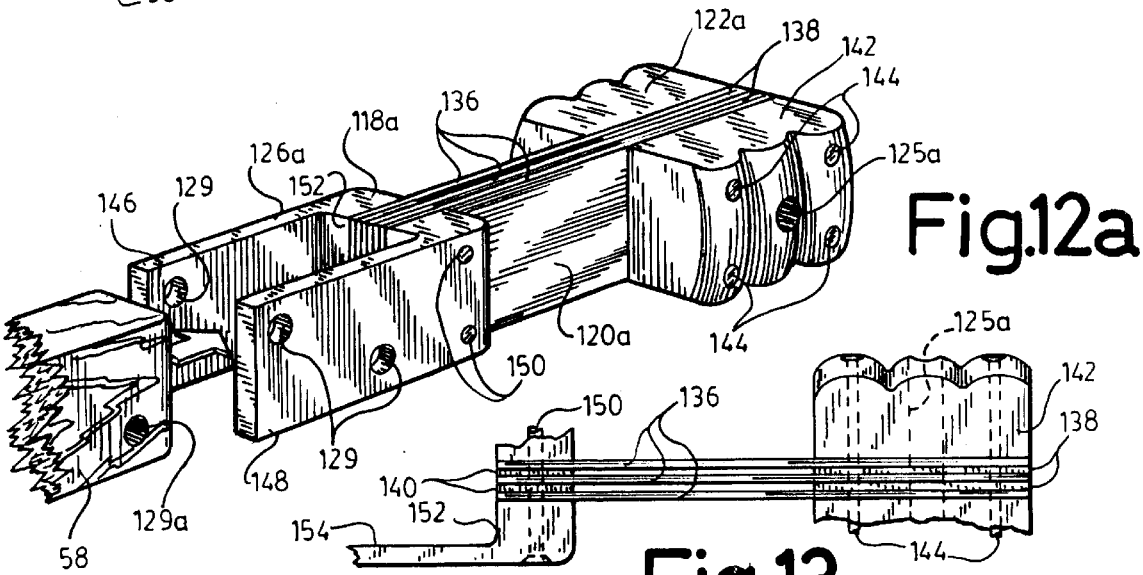
Fig.12a
Fig.13

SPORT TRAINING DUMMY

This application claims benefit of U.S. Provisional Application No. 60/014,530, filed Apr. 2, 1996.

FIELD OF THE INVENTION

This invention belongs to the field of sport training dummies used to help players practice simulation exercises. More specifically, the invention is directed to dummies used for training ice hockey players.

BACKGROUND OF THE INVENTION

During sport practices, it is noticeable that kids from five to twelve year old show a lack of attention when doing practical exercises for developing their technical abilities. A new stimulating way was required to capture and hold their attention.

The training dummy of the present invention provides a different view of the practical exercises to improve sport related abilities of players. As shown in U.S. Pat. No. 3,709,489, truncated plastic cones are typically used as obstacles in most of the basic training exercises of sports such as ice hockey. These obstacles form a path that is to be followed by players under training. One use of the present invention is to replace these typical cones by dummies with human appearance. The dummy's height is proportional to an average training player height with most of the physical characteristics of a player of the sport, in order to better simulate a real game situation i.e. a training dummy with an outline of a 10 year hockey player, head straight up, in a perfect basic position with a stick flexibly attached to the body.

The training dummy makes the practice simulation more realistic for the players, especially beginners, and can be used in countless number of exercises. The sport training dummy also simulates an adverse party player to be moved around. Because of the dummy's height, a player has to practice good habits such as establishing eye contact with other players and keeping his/her head straight up in order to evaluate what is behind the dummy while moving around it, as opposed to typical cones which do not hide any portion of the playing field. Because it is made of highly resistant material, the sport training dummy may be used for practices at any level of play, from beginner to professional.

OBJECTS OF THE INVENTION

An objective of the present invention is to make easier the learning of a sport, especially for young beginners. Other objectives of the present invention are to provide a human like easily assembled and handled dummy, a stable and lightweight dummy and, a safe and highly resistant sport training dummy.

SUMMARY OF THE INVENTION

The present invention consists of a sport training dummy adapted to be installed onto a playing field to simulate the presence of either a teammate or an adverse party player and comprising in combination a generally flat body having a general outline and height of a player.

The present invention is directed to a sport training dummy adapted to be installed into a playing field to simulate the presence of either a team mate or an adverse party player and comprising in combination:

a generally flat body having the general outline and height of a player and defining a transverse body plane, said body having a front side and a back side;

a support secured to said body to maintain said body in upright position on said playing field, even when hit from either said front side or from said back side;

an upper hand built-in within said body;

a lower hand extending out from said body; and a stick including an upper part held by both said hands and built-in within said body and a lower part protruding from said second hand.

Preferably, a resilient link attaches said lower part to said lower hand and allowing said lower part to be deflected when hit.

The resilient link preferably includes a helicoidal spring, a rubber body or a set of spaced leaf springs parallel to said body plane.

Preferably, the body is made of two body halves, each representing the front of a player.

Preferably each of the two body halves is a mirror image of the other.

The underside of said support may be covered by a rugged rubber layer or fitted with ground engaging spikes to reduce lateral displacement of the dummy on the playing field.

Preferably, the support is fixed to the body by spring clips and the body halves are fixed together by bolts at the body periphery.

More specifically, the dummy is an ice hockey training dummy and said stick is an ice hockey stick including a handle and an angled blade maintained parallel to and engaging said playing field when said dummy is in upright position, said lower part of said stick including a lower handle part.

Preferably, the support includes a cavity to be filled with ballast material and further including removable clothing covering selected areas of said body and eye simulation devices attached to said body for inducing a player to establish eye contact with said dummy.

According to another embodiment of the invention, the dummy represents an ice hockey goal tender to be installed on an ice surface and comprising a generally flat body having the general outline and height of a player and defining a transverse body plane, a support secured to said body to maintain the same in upright position, said dummy forming an outstretched arm extending out from said body and terminated by a puck catching basket, said basket representing a goal tender mitt.

Preferably, the basket is formed by netting retained between said body halves and covering a hole made through said body halves.

BRIEF DESCRIPTION OF THE DRAWINGS

The present invention and detailed aspects thereof will be more clearly understood from the following detailed description of the sport training dummy preferred embodiment, read in conjunction with accompanying drawings, wherein:

FIG. 11 is a section view along line 11—11 of FIG. 9;

FIG. 12 is a perspective exploded view of the linking means of FIG. 11;

FIG. 12*a* is a perspective exploded view of an alternate linking means of FIG. 11;

FIG. 13 is a fragmentary plan view of FIG. 12*a;*

DETAILED DESCRIPTION OF THE PREFERRED EMBODIMENT

Figure 1:
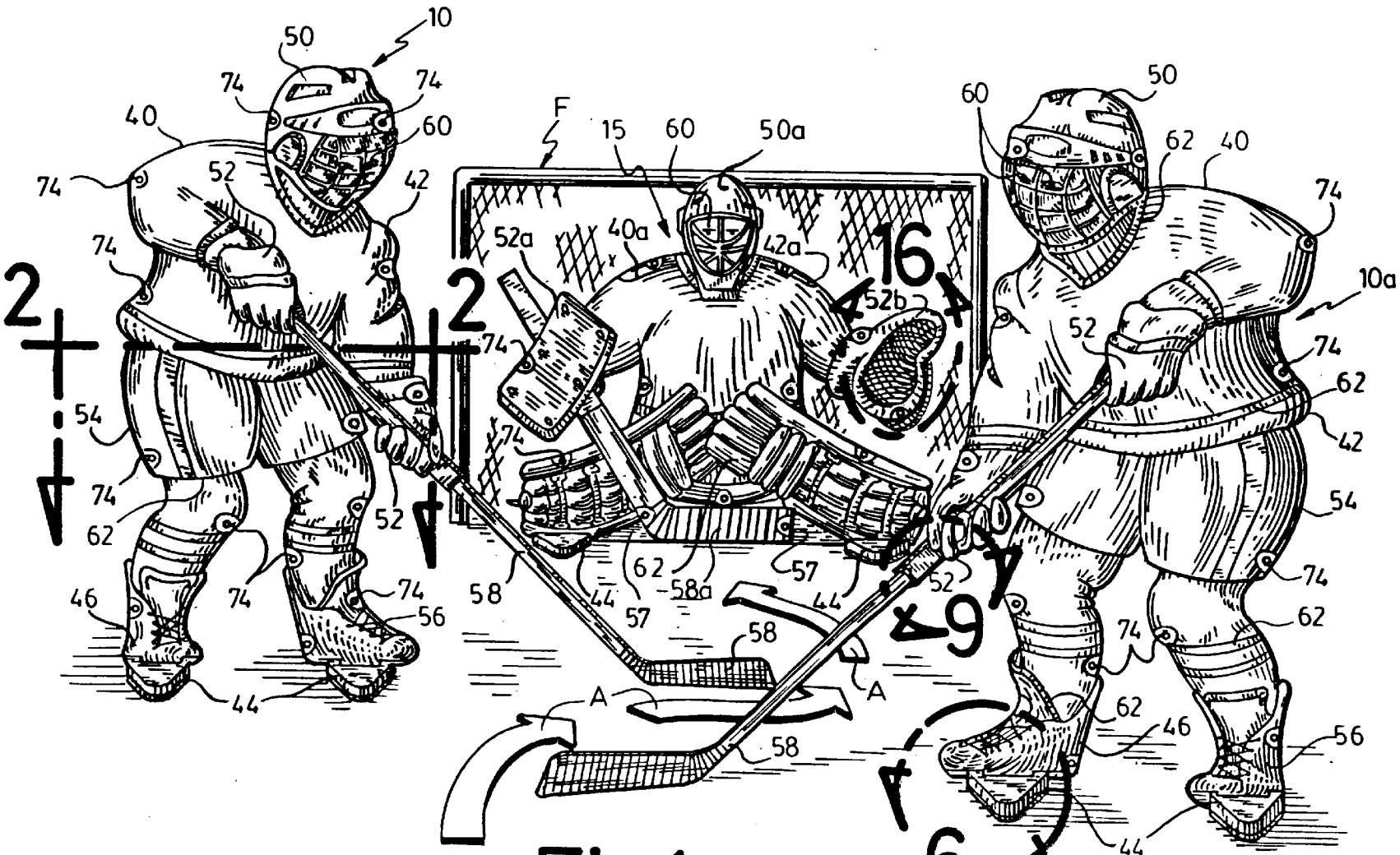
FIG. 1 shows a sport practice simulation requiring the utilization of three separate training dummies.

FIG. 1 represents three sport training dummies 10, 10*a*, 15 in position for use on a playing field, preferably ice hockey. A player under training has to follow a path A between the two player dummies 10, 10*a*, which are a mirror image of each other, before reaching a goal keeper dummy 15 located in front of a goal F. The sport training dummy 40,40*a* consists of a generally flat body 42 having the general outline of a hockey player being kept into a standing upright stable position with the use of at least two supports 44 used as prop means installed perpendicularly to a plane defined by the body 42, at the lower part 46 of the latter. Each support 46 extends out from both sides of the defined plane and, is positioned as far as possible apart from the other to enhance the stability of the dummy 40 in all direction.

In order to simulate the presence of either a teammate or an adverse party player, as realistically as possible, the dummy 40 shows some of the typical clothing devices and outfits of a hockey player such as a helmet 50, 50*a*, gloves 52, 52*a*,52*b*, pants 54, skates 56, hockey stick 58,58*a* and special closing panels 57, within the body 40*a*, used to close the access to the hockey puck. Added dummy eyes 60 may also be visible to induce players in making eye contact with training dummies 40,40*a* which is a good player ability to develop. Those typical clothing devices and outfits are provided by small and smooth relief appearances 62 engraved on the body 42.

The material of the body 42 of the dummy 40 is preferably highly resistant as well as resilient, because of all possible impacts with a hockey puck, a stick, a sharp edge of the blade of a skate or simply a player that can happen within a large range of temperature. The body 42 is also lightweight to be easily carried over and installed in place by a person. To have these characteristics, the body 42 is preferably made out of a thermoplastic material, such as the high molecular weight plastic; it may be made out of a single piece of material, hollowed monocoque type, or be assembled from two parts or halves, a front shell 64 and a back shell 66 as represented in FIG. 2.

The exterior aspect of both shells 64,66 are a mirror image of each other. The two shells 64,66 interface each other all along their periphery 68 forming the external contour of the body 42. The interface of the two shells 64,66 is mainly an overlap 70 of one shell 64 over the other one 66, as represented in FIG. 3. The flat edge 72 of the inner shell 66 is folded inwardly to allow a nice overlap 70. At many places along the periphery 68 of the body 42, attachment points 74 are provided (FIG. 1).

Figures 2, 3, 4, 4A, 5:
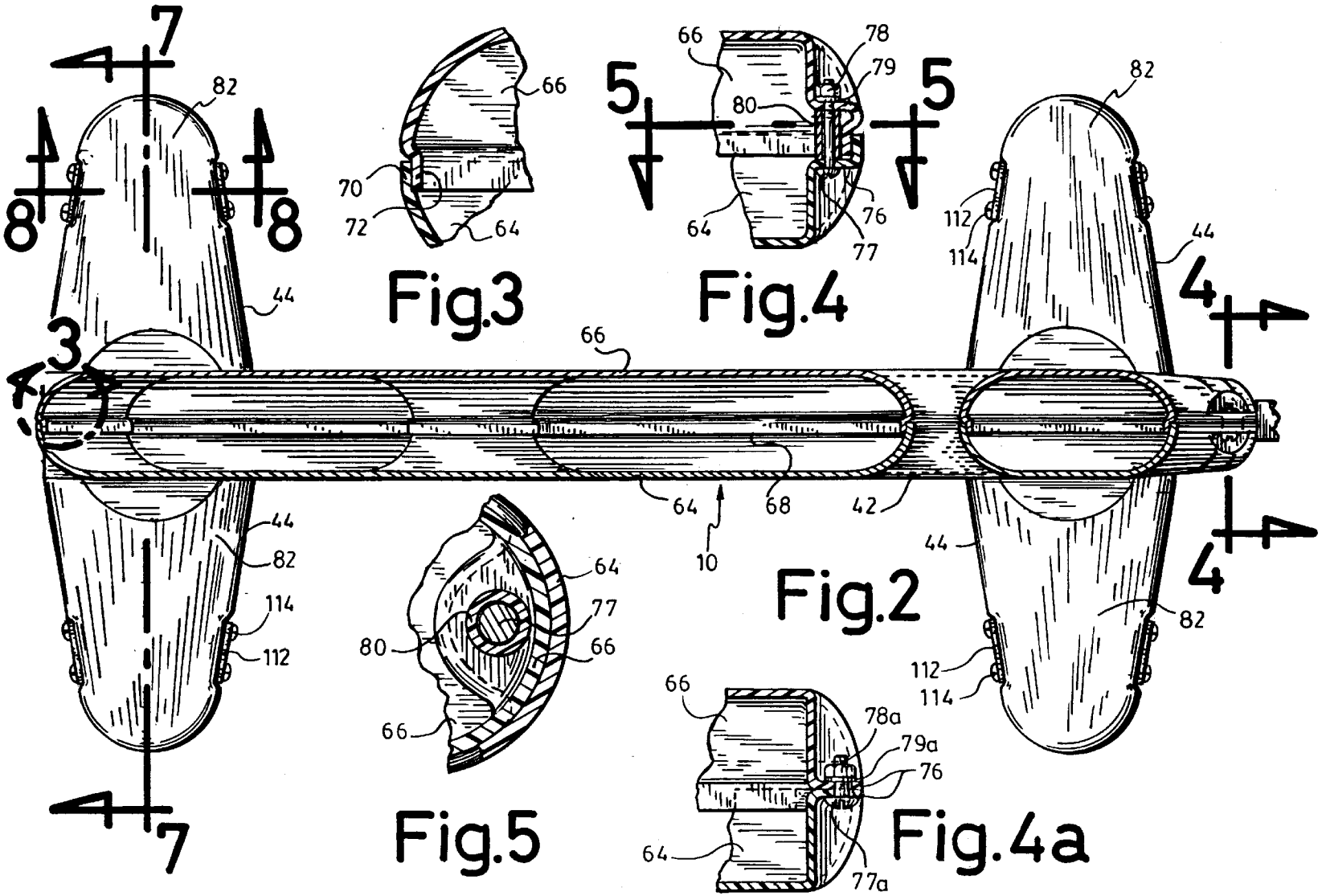
FIG. 2 is a section view along the line 2—2 of FIG. 1.
FIG. 3 is an enlarged fragmentary section view along line 3 of FIG. 2 showing the intersection of the two halves of the body of the dummy.
FIG. 4 is an enlarged section view along the line 4—4 of FIG. 2 showing an attachment device between the two halves of the body of the dummy.
FIG. 4*a* is an enlarged section view along the line 4—4 of FIG. 2 showing an alternate attachment device between the two halves of the body of the dummy.
FIG. 5 is a section view along the line 5—5 of FIG. 4.

At those attachment points 74, as shown in FIG. 4, the two shells 64,66 are slightly recessed in to form small flat surfaces 76 parallel to the body plane which allow a fastening means, preferably a typical bolt-type fastener comprised of a screw 77, a nut 78 and a washer 79, to rigidly secure the two shells 64,66 to each other by pressing them against a sleeve 80. The recess at those attachment points 74 is also used to protect the fastening means 77,78,79 from direct impacts of external objects. As an alternative fastening means 77*a*,78*a*,79*a* shown in FIG. 4*a*, the two flat surfaces 76 may touch each other avoiding the usage of the sleeve 80. FIG. 5 represents a section view of the attachment point 74.

Figures 6, 7, 8, 9, 10:
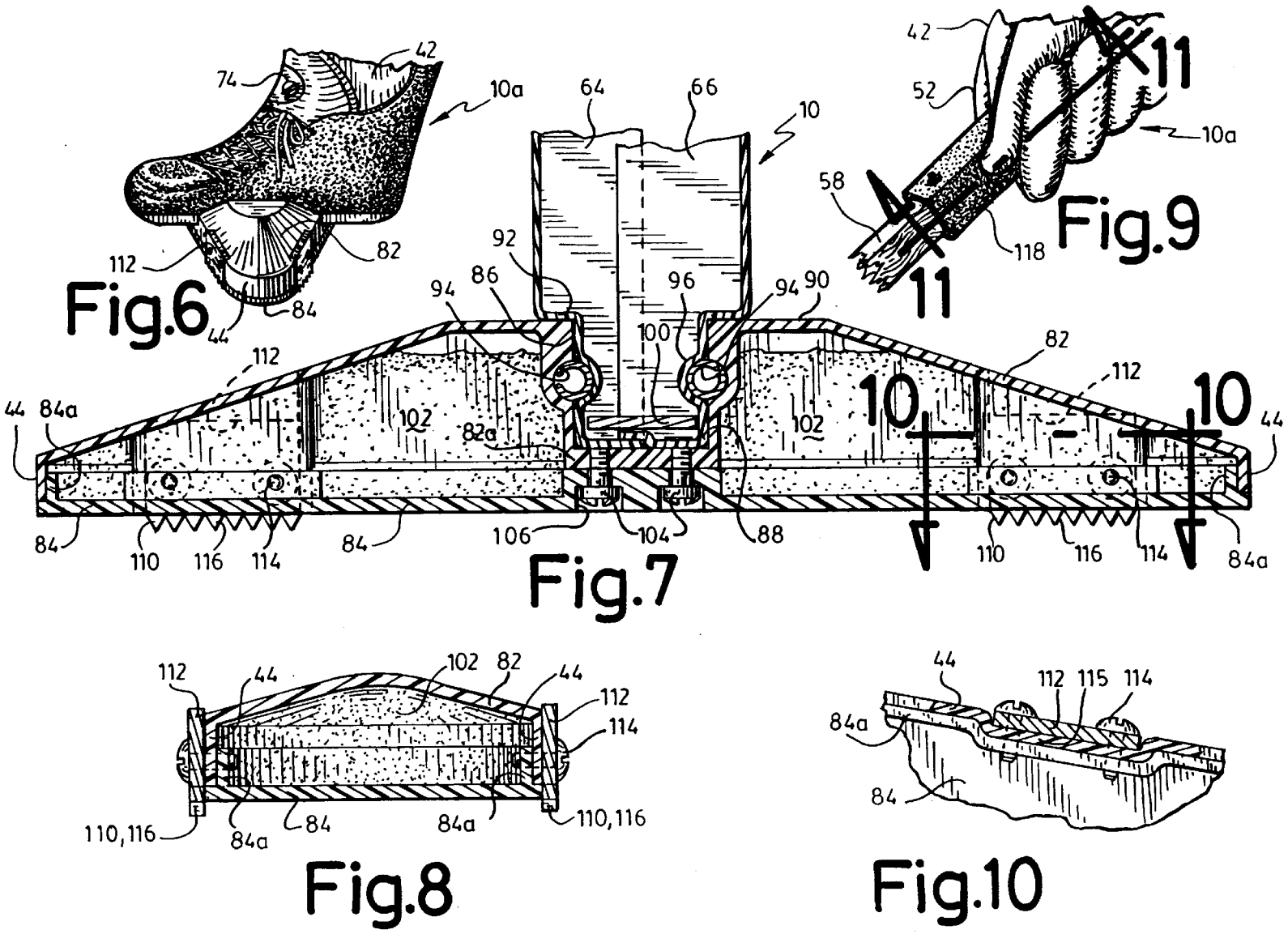
FIG. 6 is an enlarged fragmentary perspective view along line 6 of FIG. 1 showing a prop means of the dummy.
FIG. 7 is a section view along line 7—7 of FIG. 2.
FIG. 8 is a section view along line 8—8 of FIG. 2.
FIG. 9 is an enlarged fragmentary perspective view along line 9 of FIG. 1 showing a linking means between the stick and the body of the dummy.
FIG. 10 is a section view along line 10—10 of FIG. 7.

The support 44 of the sport training dummy 40, which comprises an upper part 82, and a lower part 84, is better represented in FIG. 6 in an enlarged view. Each shell 64,66 of the body 42 is rigidly attached to the support 44.

As shown in FIG. 7, the shells 64,66 sit into a U-shaped channel 86 in the support 44 in the direction of the plane of the shells 64,66. The channel 86 is narrower than the overall general thickness of the body 42 in order to have each shell 64,66 sitting onto the support 44 at both the bottom 82*a* of the channel 86 and, at the top surface 90 of the support 44 via a reversed shoulder 92 on each shell 64,66.

In order to rigidly attach each shell 64,66 to the support 44, the latter has a horizontal half-circle concave groove 94 all along and on each side of the U-shaped channel 86. Each shell 64,66 has a similar half-circle concave shape 96 directly facing a concave groove 94 on the support 44; the concave shape 96 and the concave groove 94 thus forming a cylindrical hole in which a cylindrical spring clip 98 of a slightly larger diameter is axially inserted in. The clip 98 preventing any vertical displacement of the body 42 with respect to the support 44. The small pressure generated by the clip 98 prevent any easy displacement of the body 42 with respect to the support 44 along the U-shaped channel 86 horizontal direction. In order to prevent a possible sliding of one shell 64 towards the other one 66 under the pressure generated by the two clips 98, a small rigid plate retainer 100 is inserted in-between the two shells 64,66.

The lower part 84 of the support 44, preferably flat or slightly concave, ideally covers the whole bottom surface of the support 44, thus serving as a support floor for any ballast material 102 such as sand, or sand filled pockets providing additional weighted support 44 for the dummy 40, if necessary, for additional dummy stability. The lower part 84 is attached to the upper part 82 via an attachment means such as screws 104 located underneath the body 42. The head of the screws 104 are inserted into counterbore holes 106 in order not to protrude out of the bottom surface 108 of the support 44 which is in contact with the playing field.

To prevent all sliding displacement of the dummy 40 on the playing field under normal impacts, an adhesion means 110 may be required, especially when the dummy 40 is used on playing field with a sliding type of surface such as ice. The adhesion means may consist of small plates 112 attached to the support 44 with an attachment means 114 such as screws, as represented in FIGS. 8 and 10. For safety reasons, the small plates 112 are preferably located in recessed cavities 115 on the edge of the support 44 as shown in FIG. 10. The sliding adhesion is provided with a saw-teeth type of edging 116 (FIG. 7) at the bottom edge of the small plates 112 that are attached to the support 44 in such a way that the saw-teeth 116 are protruding out of the bottom surface 108 of the support 44 to ensure a good contact with the playing field surface. This adhesion means 110 operates by the gravity force provided by the dummy weight. For safety reasons, the adhesion means 110 is intended not to restrain the dummy 40 from sliding under major impacts such as a player running into the dummy 40 at a high speed. The attachment means 114 does provide extra fixation points between the upper part 82 and the lower part 84, at a small wall 84*b* extending vertically inside, of the support 44; the attachments means 114 may still be used even if the small plates 112 of the adhesion means 110 are not required.

Sport training dummy 40 has an upper hand and a lower hand both covered by a glove 52. The upper glove covered hand is built-in within body 42 while the lower glove covered hand extends out from body 42. A hockey stick 58 defining a handle and an angled lower blade has an upper handle part built-in within body 42 and a lower handle part which freely extends from the lower glove covered hand and is attached to said lower hand via a linking means 118, as represented in FIG. 9. The linking means 118 represented in FIG. 11 is a strong resilient and flexible material such as rubber allowing the lower handle part of hockey stick 58 to rotate in any direction around the linking means 118 under an impact such as a hockey puck hitting the blade at the lower end of the hockey stick 58. The preferred direction of motion E–E' is in a plane comprising the hockey stick 58 and perpendicular to the body 42. The resilience of the linking means 118 will make the puck moving back in the opposite direction from which it comes from by forcing the stick 58 to take back its original position. The flexibility of the linking means 118 may be adapted to the level of the players, from beginners to professionals, by varying the size of its central portion 120 between the first extremity 122 firmly attached to the body 42, between the front shell 64 and the back shell 66 via a first attachment means 124 such as a bolt inserted through a first hole 125 and, the second extremity 126 firmly attached to the lower part of the hockey stick 58 via a second attachment means 128, preferably a bolt. To enhance the attachment to the body 42, the first extremity 122 of the linking means 118 assumes the internal shape of the body 42 and, has a rounded rectangular shape groove 130 to fit with the edge 132 of the local opening of the body 42. As represented in FIG. 12, the second extremity 126 of the linking means 118 has a rectangular cavity 134 to ensure a better grasp of the hockey stick 58 extremity that slides in to be attached by the second attachment means 128 inserted through a second hole 128*a* in the second extremity 126 axially aligned with a hole 128*b* in the hockey stick 58.

A first alternate linking means 118*a* is represented in FIG. 12*a*; as opposed to the linking means 118, it restrains the rotation motion to a plane comprising the stick 58 and being perpendicular to the plane of the body 42. The central and flexible portion 120*a* of the linking means 118*a* is made out of thin spring plates 136, preferably metal alloy, spaced apart by spacers 138, 140 at both extremities 122*a*, 126*a* of the linking means 118*a*. For a better attachment to the body 42 with the first attachment means 124 inserted through a first hole 125*a*, the first extremity 122*a* assumes again the internal shape of the body 42 with two rigid pieces 142 in between which the spring plates 136 and the spacers 138 are clamped with typical screws 144 (FIG. 13). In the same manner, the second extremity 126*a* provides a U-shape cavity 146 formed by two L-shape pieces 148 clamping the small plates 136 and the spacers 140 with screws 150 in between the short sides 152 of the L-shape pieces 148. Once assembled, the two long sides 154 of the L-shape pieces 148 form the two sides of the U-shape cavity 146 in which the hockey stick 58 extremity is attached to via the second attachment means 134 inserted through the second holes 129 axially aligned with the holes 129*a* of the hockey stick 58. Preferably, the rigid pieces 142, 148 are made out of rigid material such as wood, highly resistant thermoplastic or metal.

Figure 9A:
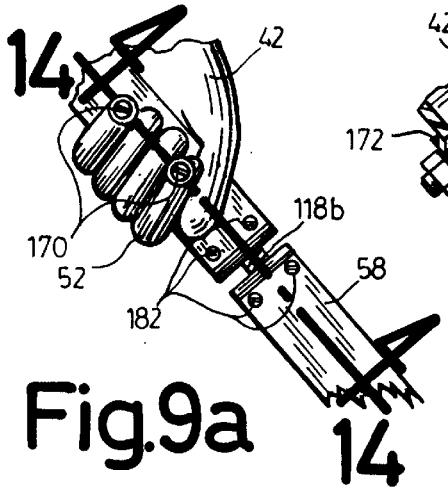
FIG. 9*a* is an enlarged fragmentary perspective view showing an alternate linking means between the stick and the body of the dummy.
Figure 14:
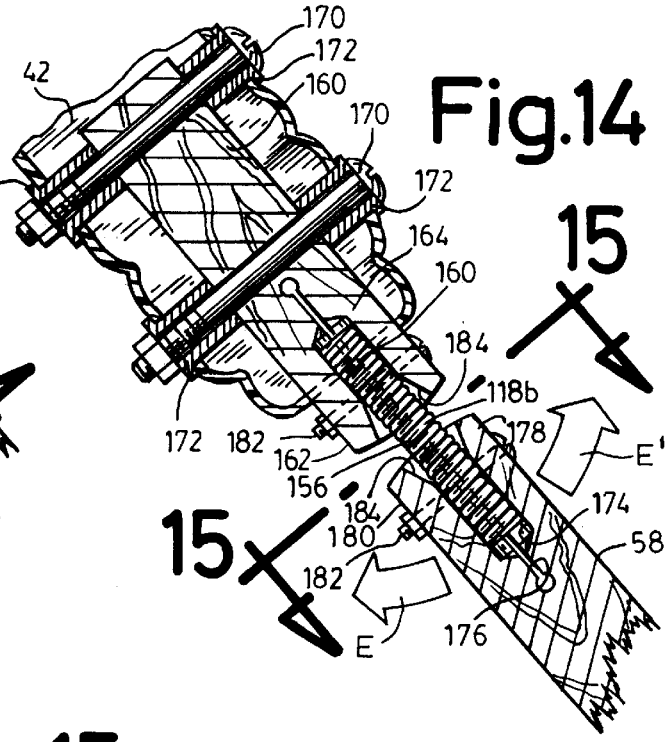
FIG. 14 is a section view along line 14—14 of FIG. 9*a;*
Figure 15:
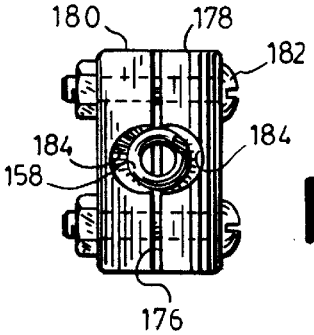
FIG. 15 is a section view along line 15—15 of FIG. 14.

A second alternate linking means 118*b* is shown in FIG. 9*a* and, comprises an helicoidal spring 156 clamped at a first end 158 inside the extremity of the hockey stick 58. The second end 160 of the spring 156 is clamped at a first end 162 of a small piece 164, preferably wood, similar to the hockey stick 58 extremity. The second end 166 of the small piece 164 is inserted into the body 42 where it is firmly secured by an attachment means 168 represented by two bolts 170 squeezing the small piece of wood 164 between two shoulder sleeves 172. The first end 158 of the helicoidal spring 156 is axially inserted into a cylindrical hole 174 of the same diameter of the spring 156 machined into the extremity of the hockey stick 58. In order to clamp the spring end 158, a slot 176 is machined in the extremity of the hockey stick 58 to locally divide it into two identical lips 178, 180, as shown in FIG. 15. Two bolts 182 oriented perpendicularly to the plane defined by the slot 176 and located on each side of the spring end 158 squeeze the latter in between the two lips 178, 180. To ease the free lateral, out of the plane of the body 42, rotation along E–E' of the hockey stick 58 while the spring 156 is being bent, narrow angle conical countersinks 184 are also machined in the two lips 178, 180. The same principle is used to clamp the second end 160 of the spring 156 to the first extremity 162 of the small piece of wood 164 secured to the body 42. Since each of the two shells 64, 66 is a mirror image of the other, the same dummy may be used with its hockey stick 58 to the left or the right while facing in the same direction as shown at 10 and 10*a* respectively in FIG. 1.

Figure 16:
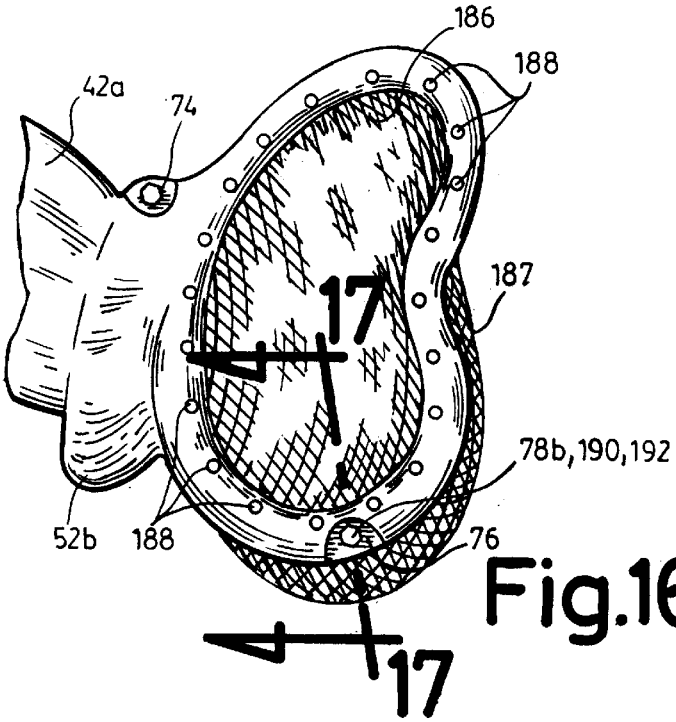
FIG. 16 is an enlarged fragmentary perspective view along line 16 of FIG. 1.
Figure 17:
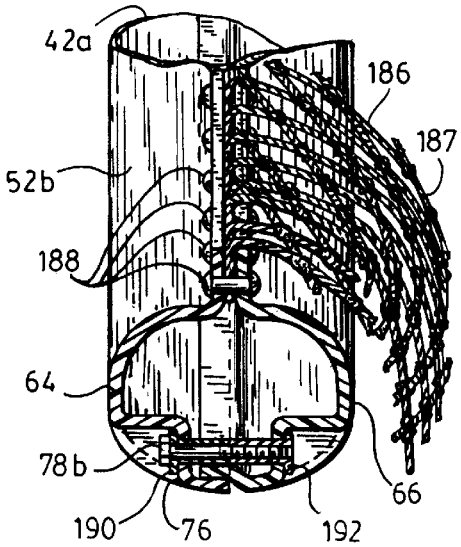
FIG. 17 is a section view along line 17—17 of FIG. 16.

Another embodiment of the present invention relates to a sport training dummy 40*a* representing a hockey goal tender with its particular outfits (FIG. 1). One of these outfits, a mitt glove 52*b*, is represented in FIG. 16. It comprises a basket like cavity 186 used to catch any puck coming at it. Preferably, the basket like cavity 186 is a cloth or a netting 187 made out of natural or synthetic resistant material such as cotton, fiberglass, nylon or the like, preferably nylon, attached to the glove 52*b* via an attachment means 188. Represented in FIG. 17, the attachment means 188, preferably a plurality of metallic rivets, squeezes the netting 187 in between the two shells 64, 66 of the body 42*a* at many locations along the periphery of a shaped hole forming the basket like cavity 186. Being attached in between the two shells 64,66 allow the basket like cavity 186 to be on either side of the body 42*a*. The two shells 64, 66 are recessed in at the attachment means 188 location in order to ensure a strong and resistant attachment means which is not directly reachable by the hockey puck or any other projectile. FIG. 17 also shows an alternate fastening means 78*b*,190,192 for the attachment points 74 where the screw 78*b* is inserted into a first shoulder sleeve 190 and screws into a second threaded shoulder sleeve 192. The two shoulder sleeves 190, 192 sit against the flat surfaces 76 of each shell 64, 66.

Figure 18:
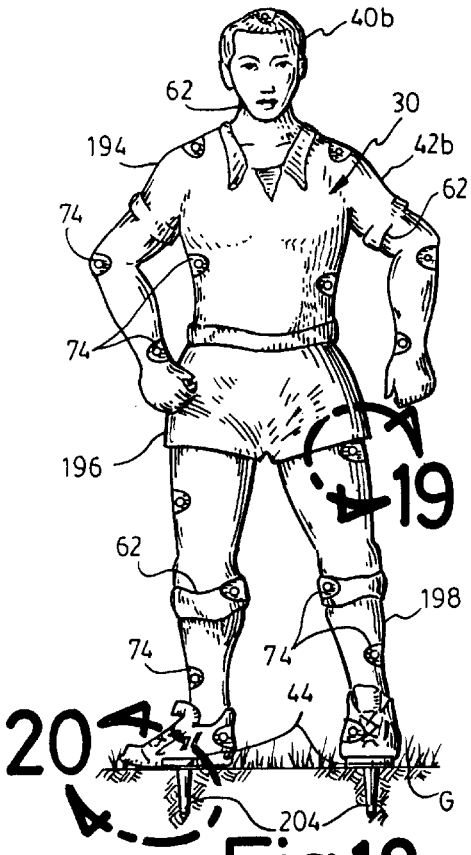
FIG. 18 is an elevation view of an alternate representation of the sport training dummy.
Figure 21:
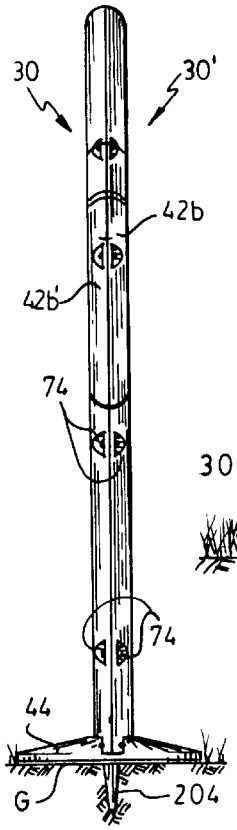
FIG. 21 is a side view of the alternate representation of the sport training dummy of FIG. 21.
Figure 19:
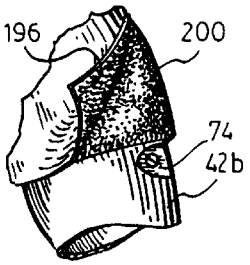
FIG. 19 is an enlarged fragmentary elevation view along line 19 of FIG. 18.
Figure 20:
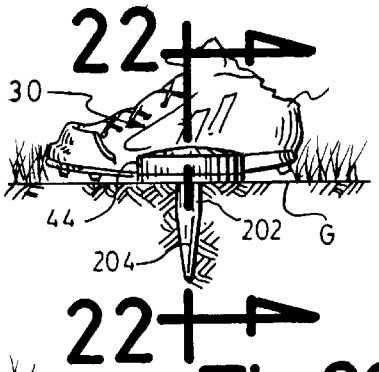
FIG. 20 is an enlarged fragmentary elevation view along line 20 of FIG. 18.
Figure 22:
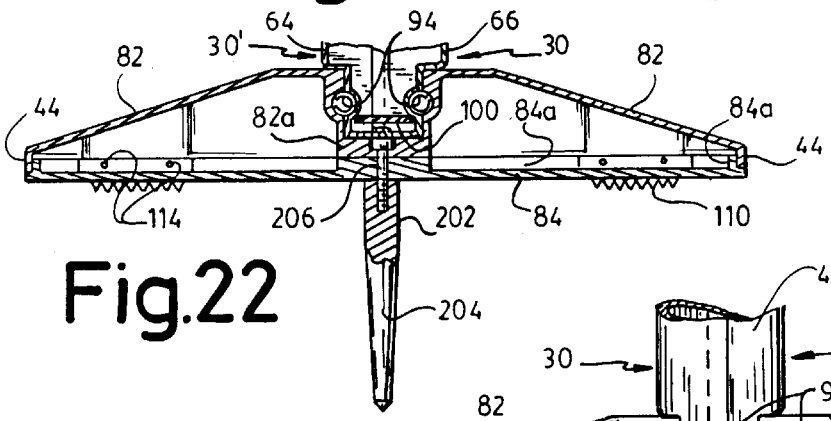
FIG. 22 is a fragmentary section view along line 22—22 of FIG. 20.

Yet another other embodiment of the present invention is shown in FIGS. 18 and 21 and, represents a soccer (football) player dummy from both sides 30, 30'. The body 42*b*,42*b*' also comprises a plurality of attachment points 74 located along the periphery of the body 42*b*,42*b*' and, small and smooth relief appearances 62 engraved on the body 42*b*, 42*b*'. The dummy 40*b* also shows some of the typical clothing devices and outfits of a soccer player such as a jersey 194, a short 196 and socks 198. FIG. 19 shows a fastening means 200, preferably a hook-loop type of tape such as Velcro (a registered trademark), attaching those typical clothing devices outfits 194, 196, 198, which may be removable add-on pieces, to the body 42*b*,42*b*'. A second type of adhesion means 202 is represented in FIG. 20. This second adhesion means 202, preferably a post 204, is additional to the first adhesion means 110 and, can be used when the playing field surface G is irregular and soft enough to have the post 204 inserted therein to eliminate all lateral displacement of the dummy 40*b* under any strong impacts such as a high speed soccer ball. As represented in FIG. 22, the post 204, preferably made out of resistant thermoplastic or metallic material, is attached to the underneath of the support 44 via an attachment means 206, preferably a screw with the head squeezed between the bottom 82*a* of the channel 86 and the body 64,66 and restrained from any rotative motion around its axis by the shape of the counter-bore within the channel bottom 82*a*, which allows the second attachment means 202 to be easily mounted or dismounted, whenever required.

Figure 22A:
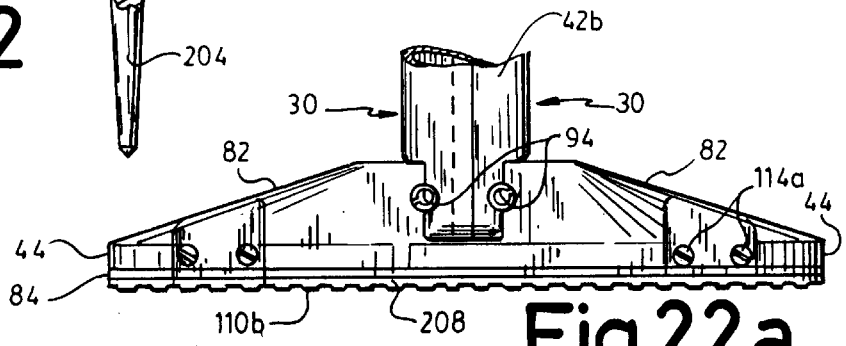
FIG. 22*a* is a side view of FIG. 20 showing an alternate adhesion means between the dummy and the playing field.

As shown in FIG. 22*a*, the previously described adhesion means 110*a* are replaced by an adhesion means 110*b* which consists of a rugged layer 208, preferably made out of rubber, permanently bonded to the bottom of the lower part 86 of the support 44. The alternate fixation points 114*a* between the two parts 84,86 of the support 44 remain used even if the first adhesion means 110 is absent.

Although only a few embodiments of the present invention has been described and illustrated, the present invention is not limited to the features of these embodiments, but includes all variations and modifications within the scope of the claims.

I claim:

1. A sport training dummy adapted to be installed into a playing field to simulate the presence of either a team mate or an adverse party player and comprising in combinaton:

a generally flat body having the general outline and height of a player and defining a transverse body plane, said body having a front side and a back side;

a support secured to said body to maintain said body in upright position on said playing field, even when hit from either said front side or from said back side;

an upper hand built-in within said body;

a lower hand extending out from said body;

a stick including an upper part held by both said hands and built-in within said body and a lower part protruding from said lower hand; and a resilient link attaching said lower part to said lower hand and allowing said lower part to be deflected when hit.

2. A sport training dummy as defined in claim 1, wherein said link includes a rubber body allowing said lower part to be deflected in any direction when hit.

3. A sport training dummy as defined in claim 1, wherein said body is made of two body halves, each representing the front of a player.

4. A sport training dummy as defined in claim 3, wherein said body having a periphery, said dummy including spring clips securing said support to said body and bolts located along the periphery of said body and securing said two body halves together.

5. A sport training dummy as defined in claim 1, further including playing field engaging spikes protruding from the underside of said support.

6. A sport training dummy as defined in claim 1, wherein said support includes a cavity to be filled with ballast material and further including removable clothing covering selected areas of said body and eye simulation devices attached to said body for inducing a player to establish eye contact with said dummy.

7. A sport training dummy as defined in claim 1, wherein said dummy is an ice hockey training dummy and said stick is an ice hockey stick including a handle and an angled blade maintained parallel to and engaging said playing field when said dummy is in upright position, said lower part of said stick including a lower handle part.

8. A sport training dummy as defined in claim 7, wherein said resilient link includes a rubber body allowing said lower handle part to be deflected in any direction when said blade or said lower handle part is hit.

* * * * *